US012653317B2

(12) United States Patent
McClure, Jr.

(10) Patent No.: US 12,653,317 B2
(45) Date of Patent: Jun. 16, 2026

(54) FLEXIBLE AND STACKABLE BED FRAME

(71) Applicant: FlexFrame, LLC, Bluffton, SC (US)

(72) Inventor: Douglas Bryan McClure, Jr., Bluffton, SC (US)

(73) Assignee: FLEXFRAME, LLC

( * ) Notice: Subject to any disclaimer, the term of this patent is extended or adjusted under 35 U.S.C. 154(b) by 0 days.

(21) Appl. No.: 19/072,856

(22) Filed: Mar. 6, 2025

(65) Prior Publication Data

US 2025/0194808 A1 Jun. 19, 2025

Related U.S. Application Data

(63) Continuation-in-part of application No. 17/738,502, filed on May 6, 2022, now Pat. No. 12,507,811.

(60) Provisional application No. 63/185,873, filed on May 7, 2021.

(51) Int. Cl.
*A47C 19/00* (2006.01)

(52) U.S. Cl.
CPC ..... *A47C 19/005* (2013.01)

(58) Field of Classification Search
CPC .... A47C 19/005; A47C 19/028; A47C 19/021
USPC ..... 5/201
See application file for complete search history.

(56) References Cited

U.S. PATENT DOCUMENTS 899,023 A * 9/1908 Bower ..... E01B 3/16 238/81
1,845,791 A * 2/1932 Gray ..... A47D 7/002 5/98.1
2,703,411 A * 3/1955 Kelly ..... A47C 17/132 297/109
2,830,606 A * 4/1958 Daugherty ..... E04H 15/20 52/2.14
3,457,684 A * 7/1969 Wood, Jr. ..... E04H 15/20 52/2.21
3,477,395 A * 11/1969 Brown ..... B65D 19/0028 108/51.3
3,927,624 A * 12/1975 Hewson ..... B65D 19/0075 108/56.1
4,000,585 A * 1/1977 Denaro ..... E04H 15/20 135/121
4,320,845 A * 3/1982 Waller ..... B65D 11/1846 206/509
4,375,848 A * 3/1983 Simpson ..... E04D 3/30 428/161
4,598,510 A * 7/1986 Wagner, III ..... E04F 15/0247 52/126.6

(Continued)

*Primary Examiner* — Justin C Mikowski
*Assistant Examiner* — Luke Hall
(74) *Attorney, Agent, or Firm* — Bradley Arant Boult 1Cummings LLP

(57) ABSTRACT

A flexible bed frame may have a base support platform for supporting a mattress and a flared or angled lip to provide lateral stability to the mattress when positioned on the frame. The frame may be made of a flexible material with sufficient elasticity to allow the frame to be rolled onto itself for storage, packing or shipping. The frame may have one or more cutouts to reduce weight of the frame. The frame may have legs which can be integrated with the support frame when the frame is a unitary piece, or which may be detachable. Legs of the frame may have hollow interior portions designed to receive a leg of corresponding shape of another bed frame when stacked onto the first bed frame.

20 Claims, 9 Drawing Sheets

(56) References Cited

U.S. PATENT DOCUMENTS 4,613,999 A * 9/1986 Franco ..... A47C 27/085 5/915
4,734,946 A * 4/1988 Saputo ..... A47C 27/085 5/915
4,815,155 A * 3/1989 Sommers ..... A47C 21/06 5/659
4,901,383 A * 2/1990 Yang ..... A47C 27/085 5/915
4,970,743 A * 11/1990 Wride ..... A47C 27/085 5/915
5,161,709 A * 11/1992 Oestreich, Jr. ..... B65D 25/005 220/4.28
5,461,988 A * 10/1995 Cummings ..... B65D 19/0075 108/56.1
5,473,785 A * 12/1995 Lager ..... A47D 9/005 5/655
5,487,345 A * 1/1996 Winebarger ..... B65D 19/0024 108/56.1
5,511,255 A * 4/1996 Schuerch ..... A61G 7/1026 5/81.1 T
5,535,668 A * 7/1996 Besaw ..... B65D 19/20 108/56.3
5,544,374 A * 8/1996 Strobel ..... A47C 19/024 5/310
5,584,951 A * 12/1996 MacFarland ..... B65D 19/0028 156/207
5,590,606 A * 1/1997 Crews ..... B65D 19/0012 108/56.1
5,676,067 A * 10/1997 Breindel ..... B65D 19/0002 108/56.1
5,704,731 A * 1/1998 Huang ..... B63B 5/24 114/264
5,745,973 A * 5/1998 Kohlhaas ..... B65D 19/40 29/432
6,094,358 A * 7/2000 Christensen ..... H05K 1/14 439/372
6,155,181 A * 12/2000 Chilcutt ..... B65D 19/0075 108/56.1
6,222,525 B1 * 4/2001 Armstrong ..... H01H 25/00 345/161
6,223,903 B1 * 5/2001 Mansouri ..... B65D 71/02 220/666
6,938,559 B2 * 9/2005 Wullenweber ..... B65D 19/08 108/51.11
6,976,435 B2 * 12/2005 Lucas ..... B65D 71/0088 108/51.11
7,426,890 B2 * 9/2008 Olvey ..... B65D 19/0036 108/56.1
7,607,628 B2 * 10/2009 Elder ..... B65D 19/0036 248/346.02
8,448,582 B2 * 5/2013 Jian ..... B65D 19/0097 108/901
8,490,228 B2 * 7/2013 Blyskal ..... A47C 19/025 5/400
8,556,112 B2 * 10/2013 Tujague, Sr. ..... B65D 88/005 108/26
8,701,651 B2 * 4/2014 King ..... F24C 15/107 126/153
9,370,241 B1 * 6/2016 Dilmaghani ..... A47B 13/08
D774,328 S * 12/2016 Shamash ..... D6/596
9,592,929 B2 * 3/2017 Marconel Carpio ..... B65D 19/0073
10,683,135 B2 * 6/2020 Gabrys ..... B65D 19/0028
11,317,726 B2 * 5/2022 Petzold Sotomayor ..... A47C 19/02
2005/0193489 A1 * 9/2005 Polumbaum ..... A47C 19/005 5/679
2011/0159756 A1 * 6/2011 Shen ..... B29C 44/5636 264/138
2014/0259404 A1 * 9/2014 Walker ..... A47G 9/062 5/485
2017/0118945 A1 * 5/2017 Cook ..... A01K 1/0117
2018/0279578 A1 * 10/2018 Thomasson ..... A01K 1/0157
2018/0352966 A1 * 12/2018 Bitzounis ..... A47C 5/10
2022/0098893 A1 * 3/2022 Chen ..... B60P 3/341
2022/0160143 A1 * 5/2022 Sari ..... A47C 23/005
2022/0192147 A1 6/2022 Chitnis

* cited by examiner

FLEXIBLE AND STACKABLE BED FRAME

CROSS REFERENCE TO RELATED APPLICATIONS

This patent application is a Continuation-In-Part of U.S. patent application Ser. No. 17/738,502, filed on May 6, 2022. U.S. patent application Ser. No. 17/738,502 claims the benefit of and priority to U.S. Provisional Application No. 63/185,873, filed on May 7, 2021. U.S. patent application Ser. No. 17/738,502 and U.S. Provisional Application No. 63/185,873 are incorporated herein by reference.

RELATED ART

Various mattresses have been developed which can be packaged and shipped to a user. Many of the current mattresses are compressible and condensed into much smaller containers than the size of the mattress once removed from the packaging. However, there are not similar "compressible" or "condensable" mattress frame materials that can easily be packaged into containers that are smaller than the main dimensions of the mattress frame. For example, traditional mattress frames have been made of two or more metal outer frames. These outer metal frames have a metal lip designed to receive the mattress, cross braces, and are often secured to a headboard.

The outer metal frames are often connected together in the middle through additional metal supports (with the use of clamps or screws), or the outer metal frames may have wooden boards placed on them to support the mattress in the middle. While the middle supports may pivot and collapse down onto the outer metal frames for shipping, the frames themselves are likely still 5-7 feet long, and can be cumbersome and very heavy to transport.

Further, conventional bedframes frequently have attached legs that protrude from a bottom side of the bed frame. The legs may be detachable, requiring a user to separately store and reattach the legs before use. This takes significant time when several bed frames are being transported and installed.

Improved techniques for providing transportable, simplified, stackable and compatible, yet aesthetically-pleasing complimentary bed frames are generally desirable.

BRIEF DESCRIPTION OF THE DRAWINGS

The disclosure can be better understood with reference to the following drawings. The elements of the drawings are not necessarily to scale relative to each other, emphasis instead being placed upon clearly illustrating the principles of the disclosure. Furthermore, like reference numerals designate corresponding parts throughout the several views.

DETAILED DESCRIPTION

A. Definitions

Figure 1:
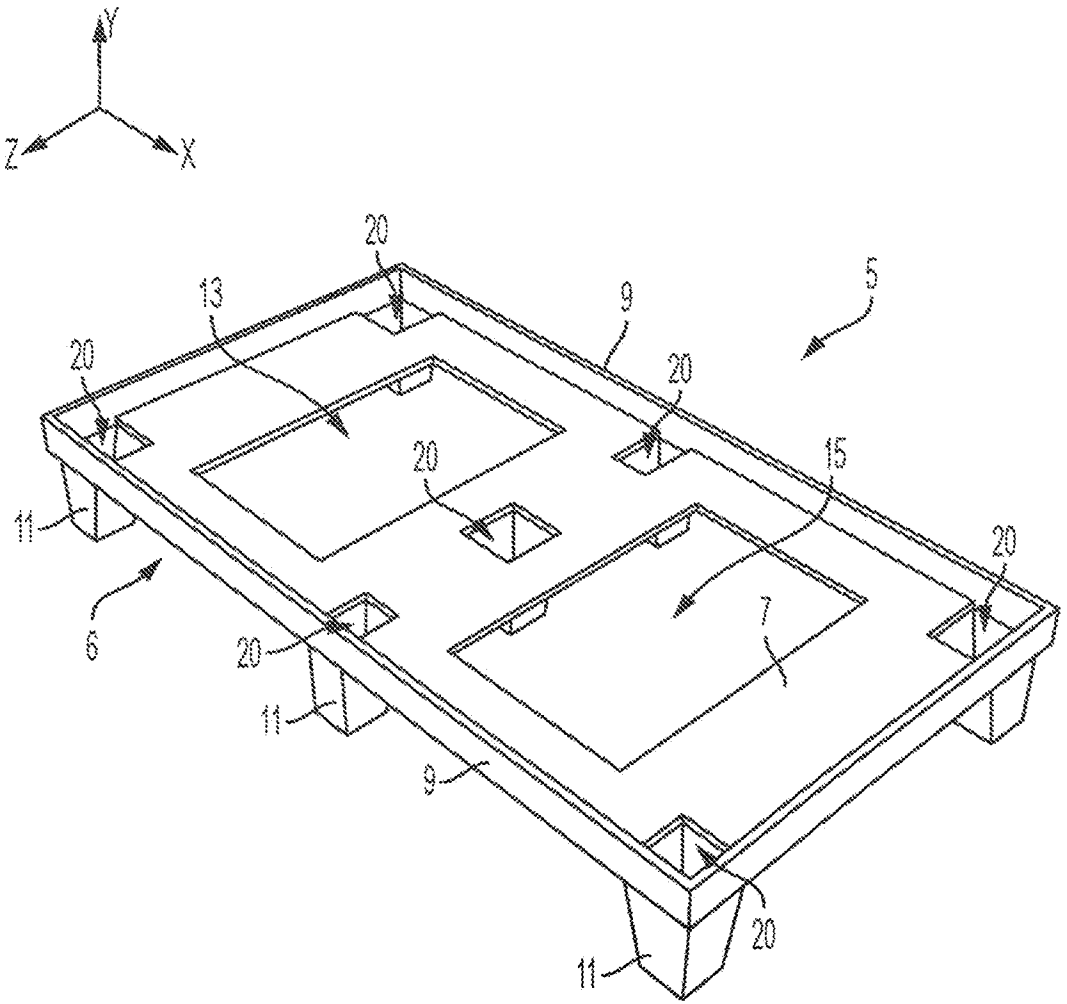
FIG. 1 is a three-dimensional top perspective view of a flexible bed frame in accordance with some embodiments of the present disclosure.

Unless otherwise defined, all terms (including technical and scientific terms) used herein have the same meaning as commonly understood by one of ordinary skill in the art of this disclosure. It will be further understood that terms, such as those defined in commonly used dictionaries, should be interpreted as having a meaning that is consistent with their meaning in the context of the specification and should not be interpreted in an idealized or overly formal sense unless expressly so defined herein. Well known functions or constructions may not be described in detail for brevity or clarity.

The terms "about" and "approximately" shall generally mean an acceptable degree of error or variation for the quantity measured given the nature or precision of the measurements. Typical, exemplary degrees of error or variation are within 20 percent (%), preferably within 10%, and more preferably within 5% of a given value or range of values. Numerical quantities given in this description are approximate unless stated otherwise, meaning that the term "about" or "approximately" can be inferred when not expressly stated.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments.

The terminology used herein is for the purpose of describing particular embodiments only and is not intended to be limiting. As used herein, the singular forms "a", "an" and "the" are intended to include the plural forms as well, unless the context clearly indicates otherwise.

Spatially relative terms, such as "under", "below", "lower", "over", "upper" and the like, may be used herein for ease of description to describe one element or feature's relationship to another when the apparatus is right side up.

The terms "first", "second", and the like are used herein to describe various features or elements, but these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present disclosure.

Terms such as "at least one of A and B" should be understood to mean "only A, only B, or both A and B." The same construction should be applied to longer list (e.g., "at least one of A, B, and C").

The term "consisting essentially of" means that, in addition to the recited elements, what is claimed may also contain other elements (steps, structures, ingredients, components, etc.) that do not adversely affect the operability of what is claimed for its intended purpose as stated in this disclosure. Importantly, this term excludes such other elements that adversely affect the operability of what is claimed for its intended purpose as stated in this disclosure, even if such other elements might enhance the operability of what is claimed for some other purpose.

In some places reference is made to standard methods, such as but not limited to methods of measurement. It is to be understood that such standards are revised from time to time, and unless explicitly stated otherwise reference to such standard in this disclosure must be interpreted to refer to the most recent published standard as of the time of filing.

B. Flexible Bed Frame

The present invention is directed to an improved bed frame support structure. A flexible bed frame 5 may have a base portion 6 comprising a base support platform 7 for supporting a mattress and a flared or angled lip 9 to provide lateral stability to the mattress when positioned on the frame. The frame 5 may be made of a flexible material with sufficient flexibility and elasticity to allow the frame to be rolled onto itself for storage, packing or shipping. The frame may have one or more cutouts 13, 15 to reduce weight of the frame. The frame may have base supports 11 (sometimes referred to herein as "legs") which can be integrated with the base portion when the frame is a unitary piece, or which may be detachable in other embodiments. Legs 11 of the frame may have hollow interior portions accessible via openings 20 on the base portion 6, configured to receive a leg of corresponding shape of another bed frame when stacked onto the bed frame.

The frame may be rolled-up for packing and shipping in some embodiments, and may be suitably compactible, condensable, compressible, foldable, hinged etc. to achieve the functionality ascribed to some embodiments of the bed frame described herein.

Figure 2:
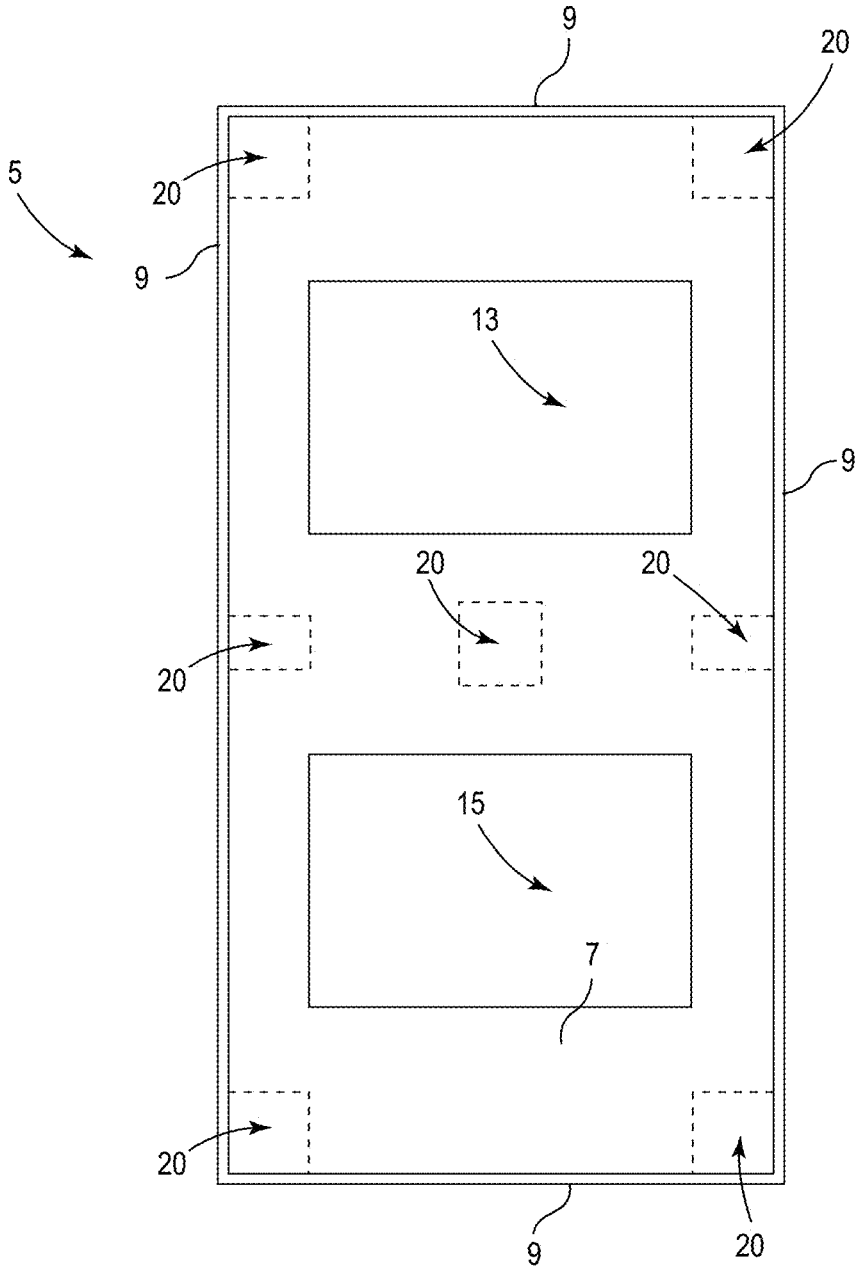
FIG. 2 is a top perspective view of a flexible bed frame in accordance with some embodiments of the present disclosure.
Figure 3:
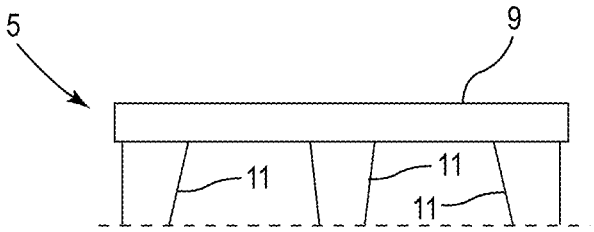
FIG. 3 is an end perspective view of a flexible bed frame in accordance with some embodiments of the present disclosure.
Figure 4:
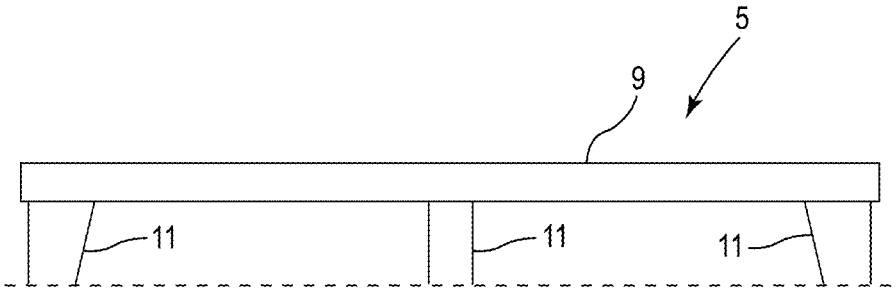
FIG. 4 is a side perspective view of a flexible bed frame in accordance with some embodiments of the present disclosure.
Figure 5A:
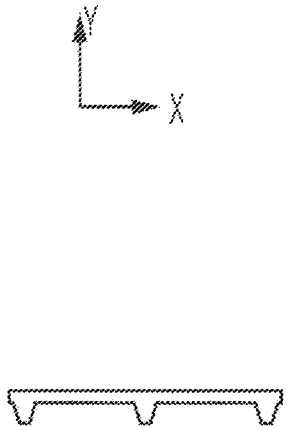
FIG. 5A shows a side view of a flexible bed frame before transitioning from an expanded position to a rolled position in accordance with some embodiments of the present disclosure.
Figure 5B:
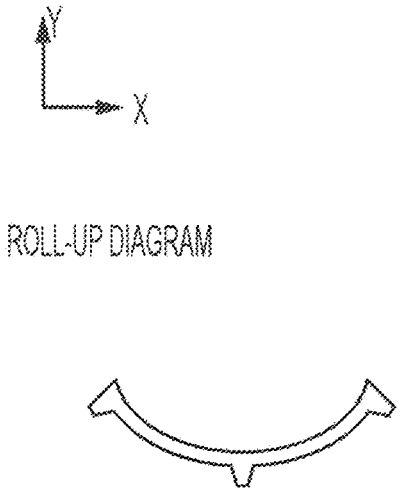
FIG. 5B shows a side view of a flexible bed frame being rolled during transition from an expanded position to a rolled position in accordance with some embodiments of the present disclosure.
Figure 5C:
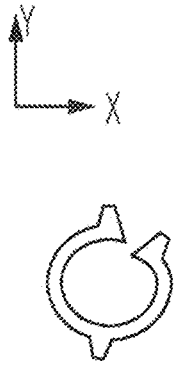
FIG. 5C shows a side view of a flexible bed frame being rolled during transition from an expanded position to a rolled position in accordance with some embodiments of the present disclosure.
Figure 5D:
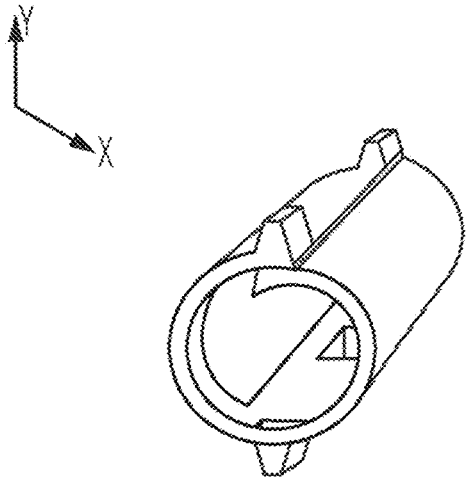
FIG. 5D shows a three-dimensional perspective view of a flexible bed frame in a rolled position in accordance with some embodiments of the present disclosure.
Figure 6A:
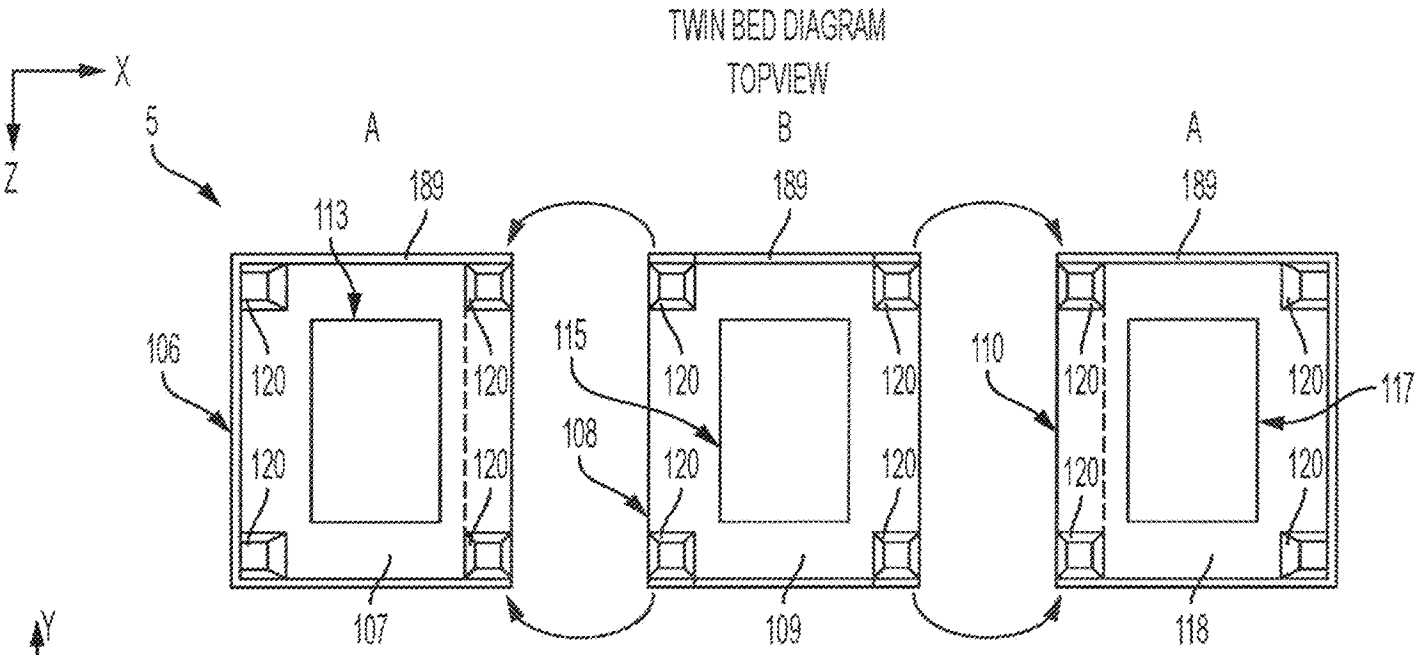
FIG. 6A shows a top perspective view of a three-part flexible bed frame in accordance with some embodiments of the present disclosure.
Figure 6B:
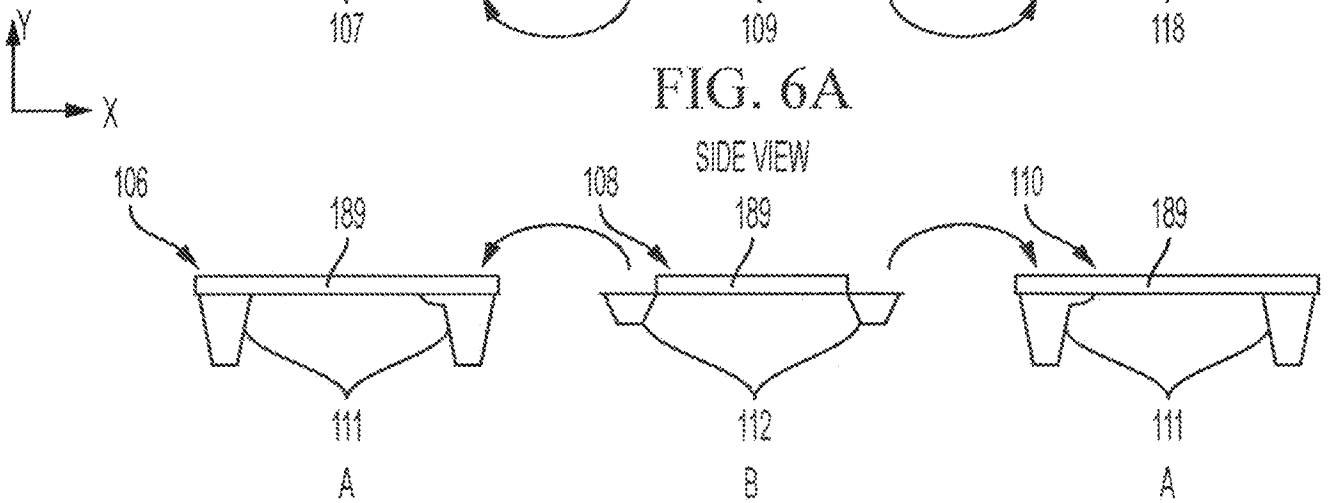
FIG. 6B shows a side perspective view of a three-part flexible bed frame in accordance with some embodiments of the present disclosure.
Figure 7B:
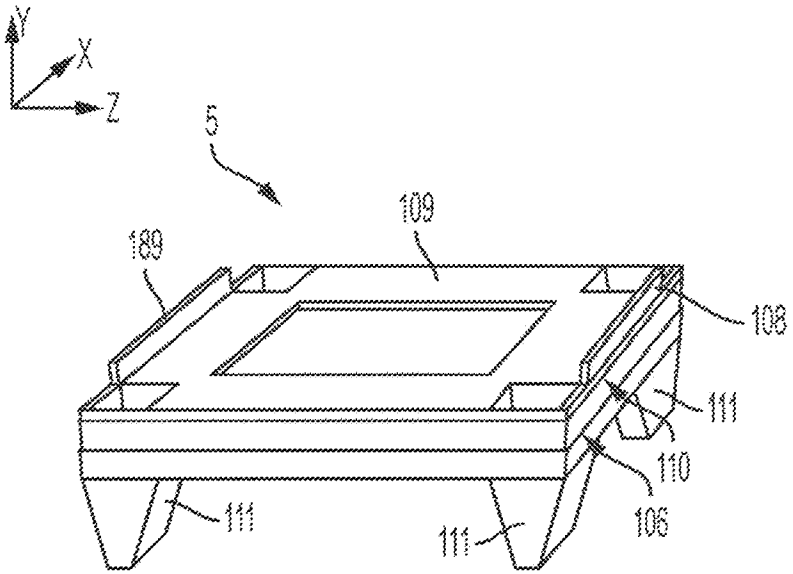
FIG. 7B is a three-dimensional view of a three-part flexible bed frame in a nested configuration in accordance with some embodiments of the present disclosure.
Figure 7C:
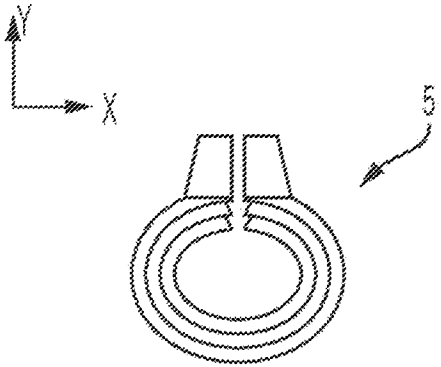
FIG. 7C is a front view of a three-part flexible bed frame in a rolled configuration in accordance with some embodiments of the present disclosure.
Figure 7A:
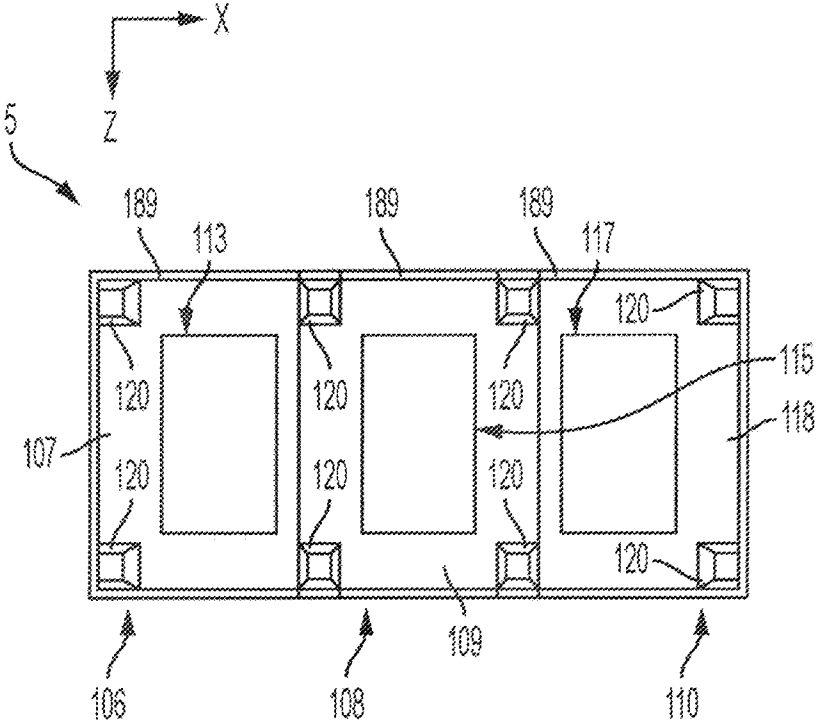
FIG. 7A is a top view of an assembled three-part flexible bed frame in an assembled configuration in accordance with some embodiments of the present disclosure.

FIG. 1 is a three-dimensional top perspective view of a flexible bed frame; FIG. 2 is a top perspective view of a flexible bed frame; FIG. 3 is an end perspective view of a flexible bed frame; FIG. 4 is a side perspective view of a flexible bed frame; FIG. 5A shows a side view of a flexible bed frame before transitioning from an expanded position to a rolled position; FIG. 5B shows a side view of a flexible bed frame being rolled during transition from an expanded position to a rolled position; FIG. 5C shows a side view of a flexible bed frame being rolled during transition from an expanded position to a rolled position; FIG. 5D shows a three-dimensional perspective view of a flexible bed frame in a rolled position; FIG. 6A shows a top perspective view of a three-part flexible bed frame; FIG. 6B shows a side perspective view of a three-part flexible bed frame in accordance with some embodiments of the present disclosure; FIG. 7A is a top view of an assembled three-part flexible bed frame in an assembled configuration in accordance with some embodiments of the present disclosure; FIG. 7B is a three-dimensional view of a three-part flexible bed frame in a nested configuration in accordance with some embodiments of the present disclosure; FIG. 7C is a front view of a three-part flexible bed frame in a rolled configuration in accordance with some embodiments of the present disclosure.

In an embodiment, the bed frame 5 may be made from lightweight plastics or similar materials, further described below. This may reduce weight and make the frame 5 easier for a user to transport. But the frame 5 also may have a shape configured to reduce an amount of frame material needed, so that frame 5 may only have approximately as much frame material as needed in order adequately and safely to support a mattress and box spring set. For this reason, frame 5 may have a base support platform 7 having a ladder shape, having spaces or cutouts 13 and 15 included to reduce frame material and save weight. Thus, the support platform 7 provides surfaces positioned adjacent to and over legs 11 for supporting a mattress, box frame or both (not shown) and for connecting the legs to the frame 5.

Frame 5 may be configured to stack on top of another other frame 5. A frame 5 may have one or more hollow legs 11 with an upper opening 20 and a lip 9. When stacking a second frame 5 on top of a first frame 5, each leg 11 of the second frame 5 may be positioned over and inserted into openings 20 of corresponding legs 11 of the first frame 5. The legs of the second frame 5 maybe inserted into the interiors of legs of the first frame 5 until contact is made between either or both of: 1) a bottom exterior portion of one or more legs of the second frame 5 and an bottom interior of one or more of the legs 11 of the first frame 5; 2) a top surface of the base support platform 7 of the first frame 5 and an underside of the base support platform of the second frame 5; or 3) an underside of the second frame and a top surface of the first frame 5. An underside of the second frame may be in contact with an upper side (e.g., an upper surface of base support platform 7) when stacked together. Similarly, the first frame 5 may be configured to stack onto a third frame 5 in a similar fashion as described above with regard to the second frame 5 stacking onto the first frame 5. Virtually any number of additional bed frames 5 may be stacked above or beneath a frame 5, as a user may desire.

A bed frame 5 may comprise specific components in some embodiments as described herein, but it will be apparent to a person of ordinary skill that additional features may be possible to achieve the functionality ascribed herein to the bedframe 5 and its components.

In some embodiments, the bed frame 5 may comprise a single base portion 6. Base portion 6 may comprise a lip 9 to provide lateral stability to a mattress or box spring positioned on the bed frame 5. The lip 9 may be angled slightly outward to facilitate stacking of multiple frames together (e.g., when a frame 5 is stacked on top of another frame 5, or when a base portion 6 is stacked on another base portion 6, such as in FIGS. 6A and 6B and 7A-7C). In some embodiments, the bed frame lip 9 may be angled between approximately 0 degrees (measured from an axis which may be referred to as a "vertical" axis herein—such as Y axis in FIG. 1—that is approximately orthogonal to a plane representing a surface on which the frame is positioned, such as the plane defined by the X and Z axes in FIG. 1, which may be referred to herein as a plane in which "lateral" movement occurs) and approximately 45 degrees; in some embodiments, between approximately zero degrees and approximately 30 degrees; in some embodiments, between approximately zero degrees and approximately 20 degrees; and in some embodiments, between approximately zero and approximately 10 degrees.

In some embodiments, a height of the bed frame lip 9 can be varied or adjusted. In an embodiment, the bed frame lip may be between approximately one inch and approximately 6 inches; in some embodiments, between approximately one inch and approximately 3 inches; in some embodiments, between approximately 0.5 inch and approximately 6 inches. The bed frame may have a wall width (e.g., wall thickness) of varying thicknesses, but in some embodiments, between approximately 0.1 inches and approximately 1 inches; alternatively, in some embodiments, between approximately 0.1 inches and approximately 2 inches.

Legs 11 can have various cross-sectional and volumetric shapes, including square, rectangular, cylindrical, tapered, conical, spherical, hemispherical, decorative, etc.

A width and length of a bed frame 5 can be configurable or fabricated to receive various number of different mattress sizes, and may be fabricated to receive a desired mattress type and size. In some embodiments, such sizes may include: a twin; a full; a Queen; a King; a California King, and various other mattress sizes and shapes. The bed frame lip may be configured so that it is slightly wider and longer than the mattress for which it supports, and preferably less than approximately two (2) inches wider and approximately one inch longer. For example, if a standard King mattress is 76 inches in width and 80 inches in length, the bed frame width would preferably be between 78 inches and 76 inches, and the width between 80 inches and 82 inches. In this regard, a user can more easily position the mattress on the bed frame.

The base portion 6 of bed frame 5 has a base support platform 7 designed to receive and support the underside of one or more of a mattress and a box spring (not specifically shown). The base support platform 7 is preferably between approximately 0.5 inches and approximately 2 inches in depth (i.e., thickness). A base support platform also may have "cut-outs," which may reduce an amount material required for the base support platform, thereby reducing weight of the base support platform and frame overall.

In the embodiment shown in the figures, the base support platform 7 has two "cut-outs", one toward the front of the frame (where a user's shoulders and upper torso may be positioned), and one toward the end of the frame (where a user's thighs and knees may be positioned). Other configurations are possible in some embodiments. For example, the base support platform 7 may have a number of rectangular cutouts (e.g., cutouts 13, 15) such that the base support platform resembles that of a "ladder" frame configuration, wherein a number of wooden boards, or slats, are positioned laterally across a width of the frame to provide support. Such slats may be equally spaced along the length of the bed frame. In some embodiments, the cutouts can have a width of up to approximately 85 percent of the overall width of the bed frame, and an overall length of up to approximately 66 percent of the length of the frame across the length. Other ratios of cutout width to frame length may be possible in some embodiments.

In some embodiments, one or more adapter cones (not specifically shown in the figures) can be used to increase an overall height of the bed frame support platform, allowing a user to configure the bed frame to provide a desired height for the platform and thus mattress when positioned on the frame. An adapter cone can be configured to receive a leg of the base platform (e.g., by passing a portion of the leg through an opening of the cone). For example, an adapter cones may be inserted into an aperture of a leg and continue until fit against an interior portion of the leg (e.g., when the adapter cone reaches a portion of the leg in which cross-sectional area of the adapter cone meets or exceeds a cross-sectional area of an interior portion of the leg). An adapter cone may provide an additional height of between approximately two and approximately 12 inches in some embodiments. The legs preferably have a tapered construction as shown in the drawings. However, a tapered configuration is not required, but it does improve stability and stackability when the support platforms are stacked for shipping.

The bed frame may be made configured as a roll-up bed frame. FIGS. 5A-5D show progression of the bedframe being rolled into a stored configuration. It will be understood that the frame 5 shown in FIGS. 5A-5D lacks particular features shown in other views of the frame 5 in order to provide clarity for the viewer. The bed frame 5 may have a desired bendability and pliability so that the frame can be rolled onto itself into a "rolled position" (e.g., is "rollable") for packaging, storage or transport. In such a "rolled position," the bed frame may have an essentially cylindrical cross-section (e.g., FIG. 7). The base, legs, or lip may have integrated features that assist in securing the bed frame support structure in a rolled configuration. For example, there may be snaps, loops, or hooks that can be used to secure cords, ties, adhesives, or other wraps. In some embodiments, as shown in FIG. 5D, legs 11 from one end of the frame 5 may be inserted into hollow portions of legs on another end of the frame or into hollow portions of the center legs in order to keep the frame in the rolled position (e.g., FIGS. 5A-5D). The frame may be unrolled into an essentially flat position (e.g., as when in use to support a mattress, an "unrolled position"). Bed frame legs may be removable from the support platform to allow it to roll tighter (smaller cylindrical diameter).

With reference to FIGS. 6A and 6B and 7A-7C, in some embodiments, the bed frame 5 may comprise a plurality of base portions or segments which may be linked or connected together to form bed frame 5.

As shown in the figures, in some embodiments the bed frame 5 comprises a plurality of base portions, each of which is one of two types of base portion: type "A" (a support portion) and type "B" (a linking portion). Type A portions may be configured for contacting a surface on which the bed frame is positioned to supporting a mattress and box spring. Type B portions may be "linking" portions configured to link type A portions together to form a completed and stable bed frame suitable for supporting a mattress and box spring. The type B portions link the type A portions by overlapping with a portion of the type A portions and inserting legs or tabs 112 into openings 120 of the type A portions.

The type A portions may have essentially the same features and dimensions as other type A portions, and type B portions may have essentially the same features and dimensions as other type B portions (e.g., portions are interchangeable). A bed frame 5 may comprise various numbers of type A portions and type B portions depending on dimensions of the mattress or box spring that needs to be supported by the bed frame. Dimensions of type A and type B portions may be varied based on the mattress to be supported by the bed frame and desired bed frame characteristics.

Note that type B portions have notched side lips 189 (i.e., having a shorter length than overall length of the type B portion), which are visible in FIG. 6B and FIGS. 7A and 7B. These notches are configured to accommodate lips 189 of type A portions when coupled together, as shown in FIG. 7A.

In the figures, there are three base portions: portion 106 (type "A"), portion 108 (type "B"), and portion 110 (type "A"). In some embodiments, additional portions may be linked together to form a bed frame of desired width, length, etc. As a mere example, a larger rectangular bed frame may be assembled by linking additional type A and type B portions together as in FIG. 7A. For example, an additional type B portion may be fitted to each of the type A portions on a side of the type A portions that is at a 90° angle to the side where the first type B portion is linked. An additional assembly of type A and B portions similar to that in FIG. 7A may be coupled or linked to the additional type B portions (e.g., at a 90° angle from the additional type B portions) to form a rectangular bed frame assembly. Other configurations are possible in some embodiments.

In some embodiments, at least one support 112 of base portion 108 may be inserted into at least one opening 120 of base portion 106, and a second at least one support 112 of base portion 108 may be inserted into at least one opening 120 of base portion 110 to form bed frame 5 (FIG. 7A). In this regard, a portion 108 may overlap part of each of portions 106 and 110 when the portions 106, 108 and 110 are linked together (FIG. 7A).

The base portions may have similar features to the base portion 6 described above. Base portion 106 may have a support platform 107, a base supports 111, a cutout 113, and a lip 189. Base portion 108 may have a support platform 109 a base supports 112, a cutout 115, and a lip 189. Base portion 110 may have a support platform 118, a base supports 111, a cutout 117, and a lip 189.

Note that the lip 189 is positioned on lateral sides of base portion 108, but not on longitudinal sides (sides which link with the type A portions 106 and 110) in order to allow a mattress to rest against the platform 109 and between lips 189 of the base portion 108.

Base supports 112 may have the same or similar dimensions to base supports 111, although in some embodiments, base supports 112 may be shorter in height to compensate for height differences when stacked with base supports 111.

Base portion 108 may have openings 120 to allow supports 112 to be inserted into the supports 112 via openings 120. Base portions 106 and 110 may have openings 120 for allowing base supports 111 or 112 to be inserted into base supports 111 via openings 120. In this regard, the base portions may be linked or connected (FIG. 7A) to form bed frame 5. When stacking is desired, the base portions may be disconnected and stacked or nested by positioning base portions 106 and 110 on top of one another and positioning portion 108 on top of the two stacked portions 106 and 110 (FIG. 7B).

In some embodiments, the base portions may be placed in a rolled position, shown in FIG. 7C, after being placed into a stacked or nested configuration as in FIG. 7B.

Figure 8A:
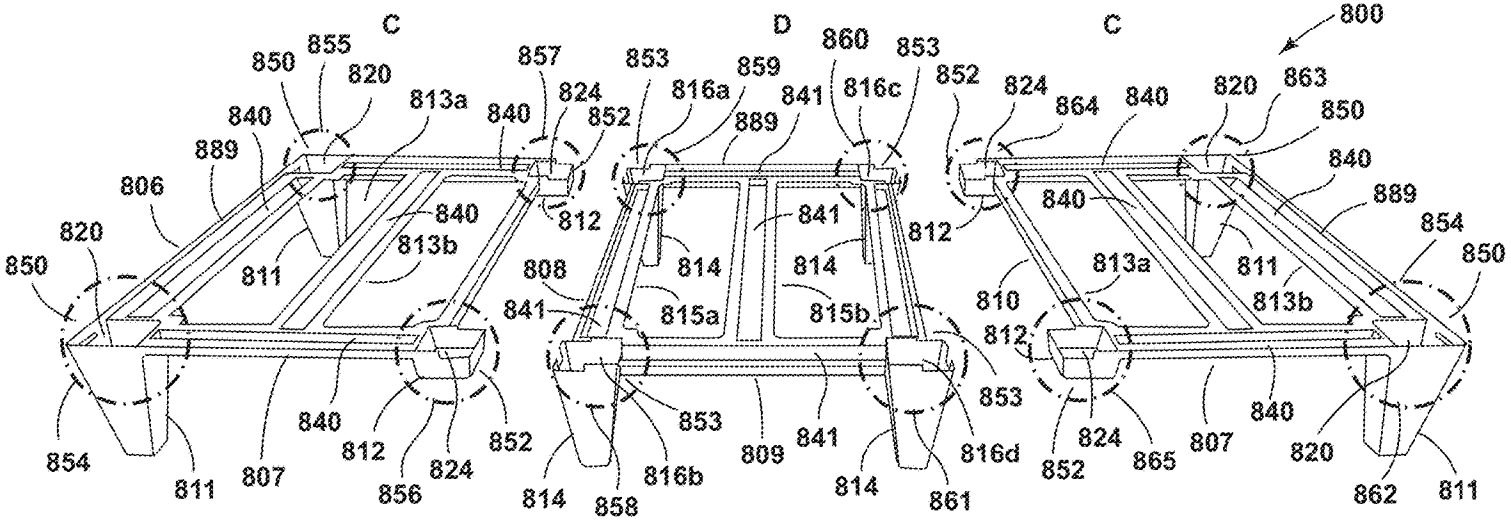
FIG. 8A is a side perspective view of a three-part flexible bed frame in accordance with some embodiments of the present disclosure.

FIG. 8A illustrates a side perspective view of a flexible bed frame 800 in accordance with some embodiments of the present disclosure. According to exemplary embodiments, the flexible bed frame 800 comprises a plurality of base portions or segments 806, 808, 810 which may be linked or connected together to form the bed frame 800. As illustrated in FIG. 8A, in some embodiments, the bed frame 800 comprises a plurality of base portions 806, 808, 810, each of which is one of two types of base portions: type "D" (a support portion) and type "C" (a linking portion). Type D portions may be configured for contacting a surface such as, for example, a floor on which the bed frame is positioned to support, for example, a mattress and box spring. Type C portions may be "linking" portions configured for contacting a surface such as, for example, a floor on which the bed frame is positioned and linking type D portions together to form a completed and stable bed frame suitable for supporting, for example, a mattress and box spring. The type C portions link the type D portions by overlapping with a portion of the type D portions and inserting legs or tabs into openings of the type D portions.

According to exemplary embodiments, type D portions may have essentially the same features and dimensions as other type D portions and type C portions may have essentially the same features and dimensions as other type C portions (e.g., portions are interchangeable). The flexible bed frame 800 may comprise various numbers of type D portions and type C portions depending on dimensions of the mattress or box spring that needs to be supported by the bed frame. Dimensions of type D and type C portions may be varied based on the mattress to be supported by the bed frame and desired bed frame characteristics.

A width and length of each of the plurality of base portions or segments 806, 808, 810 can be configurable or fabricated to receive various number of different mattress sizes, and may be fabricated to receive a desired mattress type and size. In some embodiments, such sizes may include: a twin; a full; a Queen; a King; a California King, and various other mattress sizes and shapes. For example, if a standard King mattress is 76 inches in width and 80 inches in length, the bed frame width would preferably be between 78 inches and 76 inches, and the length between 80 inches and 82 inches. In this regard, a user can more easily position the mattress on the bed frame 800.

Figure 9:
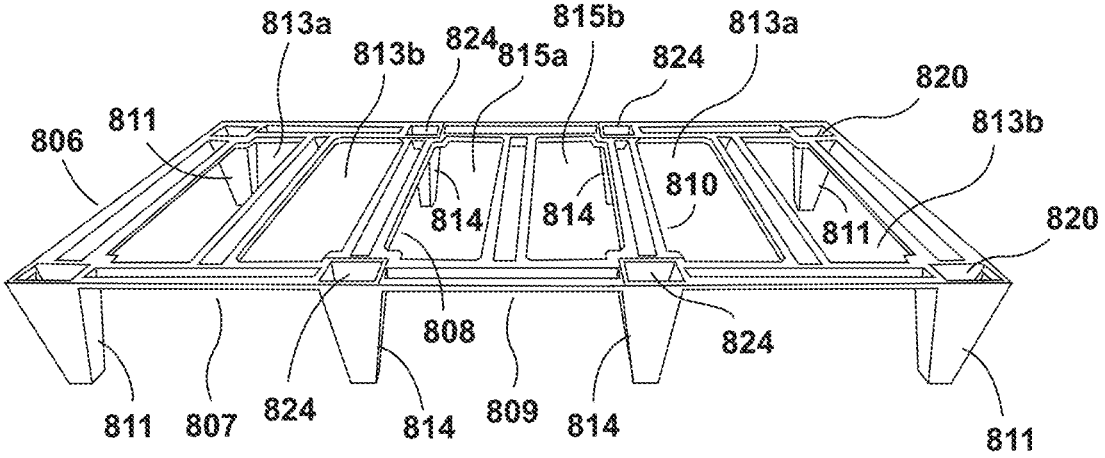
FIG. 9 is a side perspective view of the three-part flexible bed frame in an assembled configuration in accordance with some embodiments of the present disclosure.

In a typical embodiment, the three-part flexible bed frame 800 comprises a first base portion 806 (type "C"), a second base portion 808 (type "D"), and a third base portion 810 (type "C"). In some embodiments, only two base portions such as, for example, a first base portion 806 (type "C") a second base portion 808 (type "D") may be linked together to form a bed frame of desired width, length, or the like. For example, a smaller rectangular bed frame may be assembled by linking one type D and one type C portion and a larger rectangular bed frame may be assembled by linking two type C portions to one type D portion (as illustrated in FIG. 9). Other configurations are possible in some embodiments. The bed frame 800 may comprise specific components in some embodiments as described herein, but it will be apparent to a person of ordinary skill that additional features may be possible to achieve the functionality described herein to the bed frame 800 and its components.

The first base portion 806 includes a support platform 807 for supporting a mattress and a flared or angled lip 889 to provide lateral stability to the mattress when positioned on the frame 800. The first base portion 806 may be made of a flexible material with sufficient flexibility, elasticity, and sturdiness to appropriately support weight of a mattress. In a typical embodiment, the first base portion 806 is made of a thermoplastic material such as, for example, thermoplastic elastomers, CAS No. 38079-71-2, or the like). The first base portion 806 may have one or more cutouts 813(*a*)-813(*b*) to reduce weight of the first base portion 806. The first base portion 806 includes a first plurality of base supports 811 (sometimes referred to herein as "legs") which can be integrated with the first base portion 806 when the frame is a unitary piece, or which may be detachable in other embodiments. The first plurality of base supports 811 are configured for contacting a surface such as, for example, a floor on which the bed frame is positioned. The first plurality of base supports 811 can have various cross-sectional and volumetric shapes, including square, rectangular, cylindrical, tapered, conical, spherical, hemispherical, decorative, or the like.

The first plurality of base supports 811 are positioned on at least first and second regions 854, 855 adjacent to an outer perimeter 850 on a bottom side of the first base portion 806. The first plurality of base supports 811 may have hollow interior portions accessible via a first plurality of openings 820 on at least the first and second regions 854, 855 adjacent to the outer perimeter 850 on a top side of the first base portion 806. The first plurality of openings 820 are configured to receive base supports of corresponding shape of another base portion when stacked. In a typical embodiment, the first base portion 806 includes two identical base supports 811 and two identical openings 820. The support platform 807 also includes a plurality of grooves 840 that are configured to accommodate portions of other base portions.

The first base portion 806 also includes a second plurality of base supports 812. The second plurality of base supports 812 are positioned on at least third and fourth regions 856, 857 adjacent to an outer perimeter 852 on a bottom side of the first base portion 806 opposite the first plurality of base supports 811. In a typical embodiment, the second plurality of base supports 812 are shorter in height than the first plurality of base supports 811 to compensate for height differences when stacked with the first plurality of base supports 811. The second plurality of base supports 812 are configured for linking the first base portion 806 (type "C") to the second base portion 808 (type "D"). The second plurality of base supports 812 may have hollow interior portions accessible via a second plurality of openings 824 on at least the third and fourth regions 856, 857 adjacent to the outer perimeter 852 on a top side of the first base portion 806. The second plurality of openings 824 are configured to receive base supports of corresponding shape of another base portion when stacked onto the bed frame. In a typical embodiment, the first base portion 806 includes two identical base supports 812 and two identical openings 824. In a typical embodiment, the first plurality of openings 820 and the second plurality of openings 824 are dissimilar.

The second base portion 808 includes a support platform 809 for supporting a mattress and a flared or angled lip 889 to provide lateral stability to the mattress when positioned on the frame 800. The second base portion 808 may be made of a flexible material with sufficient flexibility, elasticity, and sturdiness to appropriately support weight of a mattress. In a typical embodiment, the second base portion 808 is made of a thermoplastic material such as, for example, thermoplastic elastomers, CAS No. 38079-71-2, or the like). The second base portion 808 may have one or more cutouts 815(*a*)-815(*b*) to reduce weight of the second base portion 808. The support platform 809 also includes a plurality of grooves 841 that are configured to accommodate portions of other type D and type C base portions. The second base portion 808 includes a plurality of base supports 814 (sometimes referred to herein as "legs") which can be integrated with the second base portion 808 when the frame is a unitary piece, or which may be detachable in other embodiments. The second plurality of base supports 814 are configured for contacting a surface such as, for example, a floor on which the bed frame is positioned. The second plurality of base supports 814 can have various cross-sectional and volumetric shapes, including square, rectangular, cylindrical, tapered, conical, spherical, hemispherical, decorative, or the like. In a typical embodiment, the second base portion 808 includes four identical base supports 814.

The plurality of base supports 814 are positioned on at least fifth, sixth, seventh and eighth regions 858, 859, 860, 861 adjacent to an outer perimeter 853 on a bottom side of the second base portion 808. The plurality of base supports 814 may have hollow interior portions accessible via a plurality of openings 816(*a*), 816(*b*), 816(*c*), 816(*d*) on at least the fifth, sixth, seventh and eighth regions 858, 859, 860, 861 adjacent to the outer perimeter 853 on a top side of the second base portion 808 and are configured to receive base supports of corresponding shape of another base portion when stacked. In a typical embodiment, the second base portion 808 includes four identical openings 816(*a*), 816(*b*), 816(*c*), 816(*d*). The plurality of openings 816(*a*), 816(*b*) of the second base portion 808 are configured to receive base supports 812 of the first base portion 806 into base supports 814 of the second base portion 808 via the plurality of openings 816(*a*), 816(*b*) of the second base portion 808. In some embodiments, only two base portions such as, for example, a first base portion 806 (type "C") and a second base portion 808 (type "D") may be linked together to form a bed frame of desired width, length, or the like. For example, a smaller rectangular bed frame may be assembled by linking one type D and one type C portion.

However, if a larger bed frame is desired, the larger rectangular bed frame may be assembled by linking two type C portions to one type D portion (as illustrated in FIG. 9). In such instances, the plurality of openings 816(*c*), 816(*d*) of the second base portion 808 are configured to receive base supports 812 of the third base portion 810 into base supports 814 of the second base portion 808 via the plurality of openings 816(*c*), 816(*d*) of the second base portion 808. As such, three base portions such as, for example, a first base portion 806 (type "C"), a second base portion 808 (type "D"), and a third base portion 810 (type "C") may be linked together to form a bed frame of desired width, length, or the like. In this regard, the base portions 806, 808, 810 may be linked or connected to form the three-part flexible bed frame 800 (as illustrated in FIG. 9). A width and length of the bed frame 800 can be configurable or fabricated to receive various number of different mattress sizes, and may be fabricated to receive a desired mattress type and size. In some embodiments, such sizes may include: a twin; a full; a Queen; a King; a California King, and various other mattress sizes and shapes.

When stacking is desired, the base portions 806, 808, 810 may be disconnected and stacked or nested by positioning the first base portions 806 and the third base portion 810 on top of one another and positioning the stacked base portions 806, 810 on top of the second base portion 808. In a typical embodiment, the first base portion 806 and the second base portion 808 are dissimilar. In a typical embodiment, the first base portion 806 and the third base portion 810 are substantially identical having essentially the same features and dimensions (e.g., portions 806, 810 are interchangeable). In a typical embodiment, the second base portion 808 and the third base portion 810 are dissimilar.

Note that in some embodiments, Types D and C portions may be configured to operate similarly to Types A and B portions, and vice versa. In this regard, Type D portions may have features and functionality similar to or the same as features and functionality ascribed to above Type A portions and shown, for example, in FIGS. 6A-6B and 7A-7C. Similarly, Type C portions may have features and functionality similar to or the same as features and functionality ascribed to above Type B portions and shown, for example, in FIGS. 6A-6B and 7A-7C. Similarly, Types A and B portions may have similar features and functionality as their respective Type C and D portions.

Figure 8B:
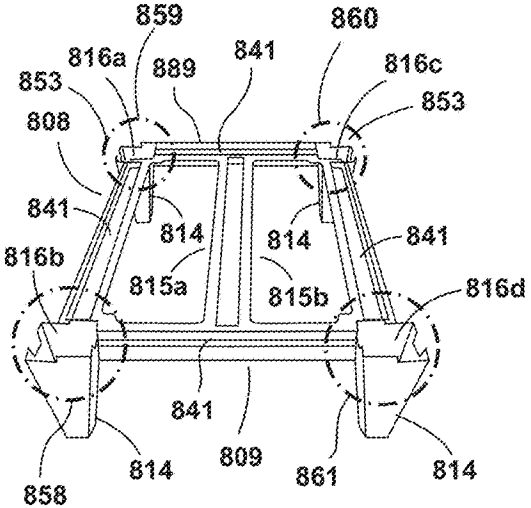
FIG. 8B is a side perspective view of a second segment of the three-part flexible bed frame in accordance with some embodiments of the present disclosure.
Figure 8C:
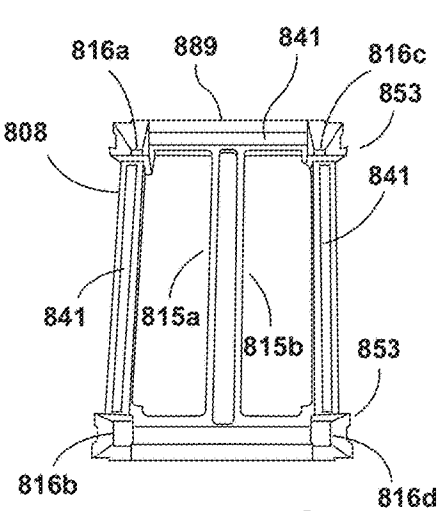
FIG. 8C is a top view of the second segment of the three-part flexible bed frame in accordance with some embodiments of the present disclosure.

FIGS. 8B and 8C illustrate a side perspective view and a top view, respectively, of the second base portion 808 of the exemplary three-part flexible bed frame 800 of FIG. 8A in accordance with embodiments of the present disclosure. In a typical embodiment, the second base portion 808 is a type D portion. Type D portions may be configured for contacting a surface such as, for example, a floor on which the bed frame is positioned to support a mattress and box spring. Details of the second base portion 808 are disclosed above with respect to FIG. 8A.

Figure 8D:
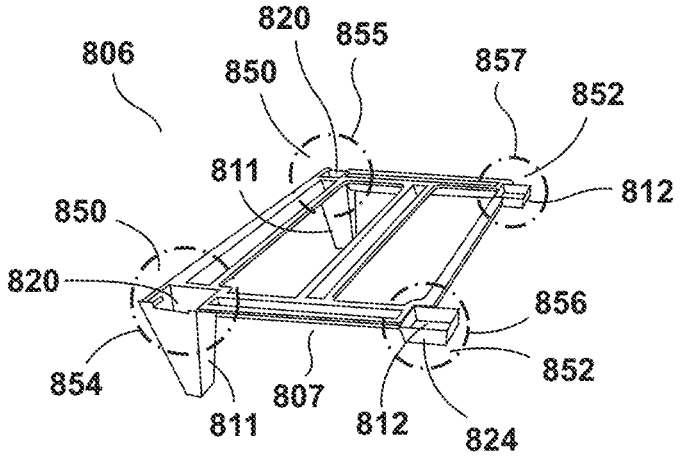
FIG. 8D is a side perspective view of a first segment of the three-part flexible bed frame in accordance with some embodiments of the present disclosure.
Figure 8E:
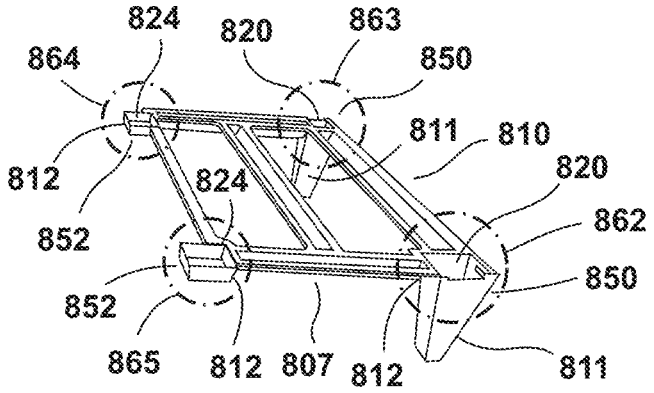
FIG. 8E is a side perspective view of a third segment of the three-part flexible bed frame in accordance with some embodiments of the present disclosure.

FIGS. 8D and 8E illustrate a side perspective view of the first base portion 806 and the third base portion 810 of the exemplary three-part flexible bed frame 800 of FIG. 8A in accordance with embodiments of the present disclosure. In a typical embodiment, the first base portion 806 and the third base portion 810 are both type C portions. The first base portion 806 and the third base portion 810 are substantially identical having essentially the same features and dimensions (e.g., portions 806, 810 are interchangeable).

For example, the third base portion 810 includes a first plurality of base supports 811 positioned on at least ninth and tenth regions 862, 863 adjacent to an outer perimeter 850 on a bottom side of the third base portion 810. The first plurality of base supports 811 may have hollow interior portions accessible via a first plurality of openings 820 on at least the first and second regions 862, 863 adjacent to the outer perimeter 850 on a top side of the third base portion 810. The first plurality of openings 820 are configured to receive base supports of corresponding shape of another base portion when stacked. In a typical embodiment, the third base portion 810 includes two identical base supports 811 and two identical openings 820.

The third base portion 810 also includes a second plurality of base supports 812. The second plurality of base supports 812 are positioned on at least eleventh and twelfth regions 864, 865 regions adjacent to the outer perimeter 852 on the bottom side of the third base portion 810 opposite the first plurality of base supports 811. In a typical embodiment, the second plurality of base supports 812 are shorter in height than the first plurality of base supports 811 to compensate for height differences when stacked with the first plurality of base supports 811. Type C portions may be "linking" portions configured to link type D portions together to form a completed and stable bed frame suitable for supporting a mattress and box spring. Details of the first base portion 806 and the third base portion 810 are disclosed above with respect to FIG. 8A.

FIG. 9 is a side perspective view of the three-part flexible bed frame 800 in an assembled configuration in accordance with embodiments of the present disclosure. As disclosed above with respect to FIG. 8A, the three-part flexible bed frame 800 comprises a first base portion 806 (type "C"), a second base portion 808 (type "D"), and a third base portion 810 (type "C"). In some embodiments, only two base portions such as, for example, a first base portion 806 (type "C") a second base portion 808 (type "D") may be linked together to form a bed frame of desired width, length, or the like. For example, a smaller rectangular bed frame may be assembled by linking one type D and one type C portion. In the embodiment illustrated in FIG. 9, a larger rectangular bed frame is disclosed in an assembled configuration by linking two type C portions 806, 810 to one type D portion 808. Details of the three-part flexible bed frame 800 are disclosed above with respect to FIG. 8A.

Figure 10A:
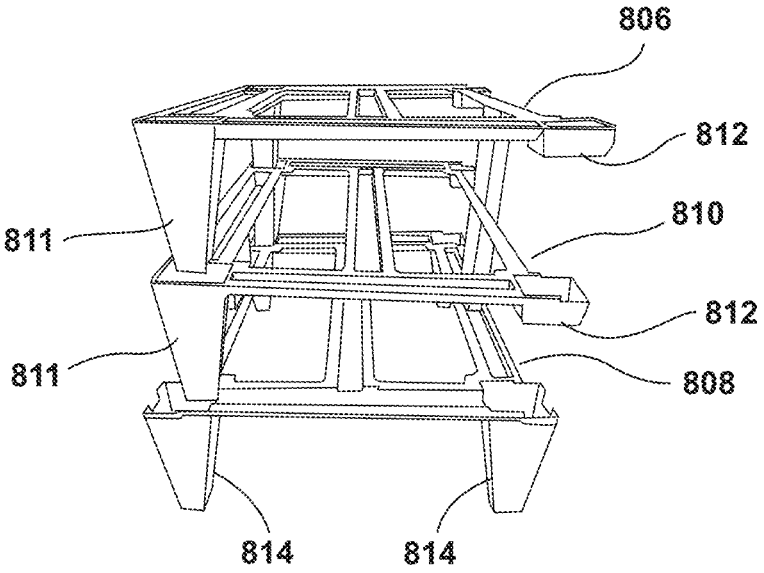
FIG. 10A is a side view of the three-part flexible bed frame prior to being in a stacked configuration in accordance with some embodiments of the present disclosure.
Figure 10B:
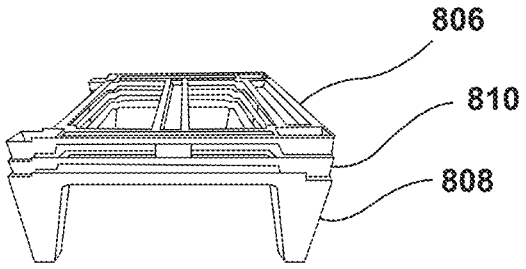
FIG. 10B is a side view of the three-part flexible bed frame in a stacked configuration in accordance with some embodiments of the present disclosure.

FIG. 10A is a side view of the first base portion 806 (type "C"), the second base portion 808 (type "D"), and the third base portion 810 (type "C") prior to being in a stacked configuration in accordance with embodiments of the present disclosure. FIG. 10B is a side view of the first base portion 806 (type "C"), the second base portion 808 (type "D"), and the third base portion 810 (type "C") in a stacked configuration in accordance with some embodiments of the present disclosure.

In a typical embodiment, when stacking is desired for packing and shipping purposes, the base portions 806, 808, 810 may be disconnected and stacked or nested by positioning type C portions (e.g., the first base portions 806 and the third base portion 810) on top of one another and positioning the stacked type C base portions 806, 810 on top of type D portion (e.g., the second base portion 808). In a typical embodiment, the second base portion 808 is positioned on the floor. Next, either one of the type C portions (e.g., first base portion 806 or the third base position 810) may be stacked on top of the second base portion 808 by fitting the first plurality of base supports 811 and the second plurality of base supports 812 of either one of the first base portion 806 or the third base position 810 into the plurality of openings 816(*a*), 816(*b*), 816(*c*), 816(*d*) of the second base portion 808. Additional base portions can be stacked above and below the first, second, and third base portions 806, 808, 810 to form a stack of virtually any desired number of base portions. In this regard, the base supports 811, 814 can be substantially hollow such that a base portion can be stacked on top of another base portion (e.g., so that they are stackable, similar to stackable plastic deck chairs that stack on top of one another). The base supports 811, 814 preferably have a wall width of between approximately 0.1 inches and approximately 1 inch. Other thicknesses are possible.

In some embodiments, the frame may comprise such materials and dimensions based on properties of such materials to provide sufficient sturdiness to appropriately support weight of a mattress, and users without unacceptable deflection, instability, or undesired motion while in use. In some embodiments, the material of the bed frame is sufficiently rigid and sturdy such that a deflection of the bed frame material at an approximate lateral center of the frame (e.g., half the width of the frame) under a distributed load of approximately 150 lbs., is no more than one inch in a direction of force applied by the load (e.g., in a direction that is approximately parallel to the direction of force applied to the frame from the loading), and preferably less than approximately ½ inch, more preferably less than approximately ¼ of an inch.

In some embodiments, the bed frame material is made of a thermoplastic material (e.g., thermoplastic elastomers, CAS No. 38079-71-2). The bed frame material can be a variety of different colors, and can be presented in color combinations that may represent certain sports teams, or organizations, for example the team colors of an educational institution such as a high school, a college or university, or even a professional sports team (e.g., football, baseball, basketball, hockey, soccer, etc.). Additionally, sides of the bed frame and the legs can also have decorative indicia of team names or mascots.

In some embodiments, the bed frame and the bed frame legs may be a single, unitary piece and of single construction (e.g., fabricated using 3D printing techniques). In this embodiment, the legs may be incorporated into and formed as part of an overall bed support structure. In one embodiment, a leg portion or more support legs positioned around the periphery of the bed frame and or across its width to support any mattress on top of the bed frame. See FIG. 1 for one exemplary configuration.

As noted above, the bed frame shown in the figures may be stacked with one or more other bed frames, such that a plurality of frames may be stacked on top of one another by positioning a first frame on top of a second frame, fitting one or more legs of the first frame inside of hollow interior portions of corresponding legs of the second frame. Additional frames can be stacked above and below the first and second frames, and as many frames may be added to form a stack of virtually any desired number of frames. In this regard, the leg members can be substantially hollow such that a bed frame support structure can be stacked on top of another bed frame support structure and the leg portions of a first frame slide into the hollow cavities of an underlying second bed frame support structure (e.g., so that they are stackable, similar to stackable plastic deck chairs that stack on top of one another). The legs preferably have a wall width of between approximately 0.1 inches and approximately 1 inch. Other thicknesses are possible.

In some embodiments, the bed frame support structure is made of substantially the same material across the legs, base, in bed frame lip. In other embodiments, one or more various additional materials may be used for one or more of the legs, base, and bed frame lip of the frame. For example, the bed frame lip may utilize a material that is lighter weight, less sturdy, and or more bendable than the material of the legs or base. Similarly, the leg may be made of different material than the base.

In some embodiments to bed frame support is made of a thermoplastic material, including but not limited to PET (CAS No. 25038-59-9), HDPE (CAS No. 9002-88-4), LDPE (CAS No. 9002-88-4), PVC (CAS No. 9002-86-2), PP (polypropylene) (CAS No. 9003-07-0), PS (polystyrene or Styrofoam) (CAS No. 9003-53-6), or other similar materials. Various polymerization agents and plasticizing polymers may be used in some embodiments. The frame also can be made from one or more rubbers or rubberized materials, including conventional natural rubber (CAS No. 9006-04-6). The frame's materials also can include other materials, such as synthetic materials.

In some embodiments, the frames 5 and 800 can be made using injection molding techniques known in the art, 3D printing techniques known in the art, or various combinations thereof.

In some embodiments, parts of the bed frame (e.g., each of the various components of bed frame described herein and in the drawings) may be separable or detachable and reattachable. Parts may be interchangeable, reversible, and may be specifically matched to fit with other particular components of the bed frame in some embodiments.

In some embodiments, the legs are not integrated to and do not form a unitary construction with the lip and or support platform. In some embodiments, legs are removable from the base support platform. This embodiment can facilitate smaller form factors for shipping (e.g., when the base support platform is in a rolled position with legs detached). In such a configuration, the legs may be hollow as discussed above, or can be of more dense construction without a void interior. In some embodiments, the base support platform has a lip design to receive a corresponding lip and or ledge of the legs. The legs can be inserted into the leg receiving compartments formed into the base support platform. Those receiving holes may be an aperture (e.g., a void) across a thickness of the base support platform, or only partially through the thickness of the base support platform. In the latter embodiment, from the top view of the base support platform, a user would not see any apertures designed to receive the legs.

U.S. Prov. Ser. No. 63/185,873 filed May 7, 2021 and entitled "Flexible Bed Frame," incorporated herein by reference, includes additional views of a bed frame in accordance with some embodiments of the present disclosure. The portion of the bed frame pictured has semi-circular legs (e.g., bulbs) that are hollow. The bulbs compress when a load is placed on the frame, causing the bulbs to deflect and "flatten" against the surface on which the frame is placed. When a bulb reaches an approximate maximum deflection, deflection stops and the bulb stabilizes, providing vertical support and stability for the frame above it. Similarly, when each bulb of the frame reaches its respective approximate maximum deflection or compression distance, deflection stops and the bulbs stabilize, providing vertical support and stability for the frame above it. Other portions of the frame in conjunction with the bulbs or legs of the frame similarly provide stability in other degrees of freedom about which the frame may move (e.g., lateral, torsional, or further vertical stability). It is to be understood that any given elements of the disclosed embodiments of the invention may be embodied in a single structure, a single step, a single substance, or the like. Similarly, a given element of the disclosed embodiment may be embodied in multiple structures, steps, substances, or the like.

The foregoing description illustrates and describes the processes, machines, manufactures, compositions of matter, and other teachings of the present disclosure. Additionally, the disclosure shows and describes only certain embodiments of the processes, machines, manufactures, compositions of matter, and other teachings disclosed, but, as mentioned above, it is to be understood that the teachings of the present disclosure are capable of use in various other combinations, modifications, and environments and is capable of changes or modifications within the scope of the teachings as expressed herein, commensurate with the skill and/or knowledge of a person having ordinary skill in the relevant art. The embodiments described hereinabove are further intended to explain certain best modes known of practicing the processes, machines, manufactures, compositions of matter, and other teachings of the present disclosure and to enable others skilled in the art to utilize the teachings of the present disclosure in such, or other, embodiments and with the various modifications required by the particular applications or uses. Accordingly, the processes, machines, manufactures, compositions of matter, and other teachings of the present disclosure are not intended to limit the exact embodiments and examples disclosed herein. Any section headings herein are provided only for consistency with the suggestions of 37 C.F.R. § 1.77 or otherwise to provide organizational queues. These headings shall not limit or characterize the invention(s) set forth herein.

The invention claimed is:

1. A bed frame comprising:

a plurality of base portions, wherein the plurality of base portions comprises a first base portion, a second base portion and a third base portion;

the first base portion comprising a first support platform, a first plurality of base supports positioned on at least first and second regions adjacent to an outer perimeter on a bottom side of the first base portion having hollow interior portions and accessible via a first plurality of openings on the outer perimeter on a top side of the first base portion, a second plurality of base supports positioned on at least third and fourth regions on the bottom side of the first base portion and accessible via a second plurality of openings on the outer perimeter on the top side of the first base portion, wherein the second plurality of base supports are shorter in height than the first plurality of base supports;

the second base portion comprising a second support platform, a plurality of base supports positioned on at least fifth, sixth, seventh and eighth regions adjacent to an outer perimeter on a bottom side of the second base portion and accessible via a plurality of openings on an outer perimeter on a top side of the second base portion;

the third base portion comprising a third support platform, a first plurality of base supports positioned on at least ninth and tenth regions adjacent to an outer perimeter on a bottom side of the third base portion having hollow interior portions and accessible via a first plurality of openings on an outer perimeter on a top side of the third base portion, a second plurality of base supports positioned on at least eleventh and twelfth regions on the bottom side of the third base portion and accessible via a second plurality of openings on the outer perimeter on the top side of the first base portion, wherein the second plurality of base supports are shorter in height than the first plurality of base supports; and wherein, in an assembled configuration, at least one base support of the second plurality of base supports of the first base portion is inserted into a first opening of the plurality of openings of the second base support, at least another base support of the second plurality of base supports of the first base portion is inserted into a second opening of the plurality of openings of the second base support, at least one base support of the second plurality of base supports of the third base portion is inserted into a third opening of the plurality of openings of the second base support, at least another base support of the second plurality of base supports of the third base portion is inserted into a fourth opening of the plurality of openings of the third base support to form a flat surface configured to receive a box spring or mattress.

2. The bed frame of claim 1, wherein the bed frame has a nested configuration whereby the plurality of openings of the second base portion are sized to receive the first plurality of base supports and the second plurality of base supports of the first base portion.

3. The bed frame of claim 1, wherein the bed frame has a nested configuration whereby the plurality of openings of the second base portion are sized to receive the first plurality of base supports and the second plurality of base supports of the third base portion.

4. The bed frame of claim 1, wherein the bed frame has a nested configuration whereby the plurality of openings of the second base portion are sized to receive the first plurality of base supports and the second plurality of base supports of the first base portion, the first plurality of openings of the first base portion are sized to receive the first plurality of base supports of the third base portion and the second plurality of openings of the first base portion are sized to receive the second plurality of base supports of the third base portion.

5. The bed frame of claim 1, wherein the first base portion and the third base portion are identical.

6. The bed frame of claim 1, wherein the first base portion and the second base portion are dissimilar.

7. The bed frame of claim 1, wherein the second base portion and the third base portion are dissimilar.

8. The bed frame of claim 1, wherein the first base portion comprises a plurality of cutouts.

9. The bed frame of claim 1, wherein the second base portion comprises a plurality of cutouts.

10. The bed frame of claim 1, wherein the third base portion comprises a plurality of cutouts.

11. The bed frame of claim 1, wherein the first plurality of openings of the first base portion are identical.

12. The bed frame of claim 1, wherein the second plurality of openings of the first base portion are identical.

13. The bed frame of claim 1, wherein the first plurality of openings of the first base portion are different from the second plurality of openings of the first base portion.

14. The bed frame of claim 1, wherein the first plurality of openings of the third base portion are different from the second plurality of openings of the third base portion.

15. The bed frame of claim 1, wherein the plurality of base supports of the second base portion are identical.

16. A bed frame comprising:

a plurality of base portions, wherein the plurality of base portions comprises a first base portion, a second base portion and a third base portion;

the first base portion comprising a first support platform, a first plurality of base supports positioned on at least first and second regions adjacent to an outer perimeter on a bottom side of the first base portion having hollow interior portions and accessible via a first plurality of openings on an outer perimeter on a top side of the first base portion, a second plurality of base supports positioned on at least third and fourth regions on the bottom side of the first base portion and accessible via a second plurality of openings on the outer perimeter on the top side of the first base portion, wherein the second plurality of base supports are shorter in height than the first plurality of base supports;

the second base portion comprising a second support platform, a plurality of base supports positioned on at least fifth, sixth, seventh and eighth regions adjacent to an outer perimeter on a bottom side of the second base portion and accessible via a plurality of openings on an outer perimeter on a top side of the second base portion;

the third base portion comprising a third support platform, a first plurality of base supports positioned on at least ninth and tenth regions adjacent to an outer perimeter on a bottom side of the third base portion having hollow interior portions and accessible via a first plurality of openings on an outer perimeter on a top side of the third base portion, a second plurality of base supports positioned on at least eleventh and twelfth regions on the bottom side of the third base portion and accessible via a second plurality of openings on the outer perimeter on the top side of the first base portion, wherein the second plurality of base supports are shorter in height than the first plurality of base supports; and wherein the bed frame has a nested configuration whereby the plurality of openings of the second base portion are sized to receive the first plurality of base supports and the second plurality of base supports of the first base portion, the first plurality of openings of the first base portion are sized to receive the first plurality of base supports of the third base portion and the second plurality of openings of the first base portion are sized to receive the second plurality of base supports of the third base portion.

17. The bed frame of claim 16, wherein, in an assembled configuration, at least one base support of the second plurality of base supports of the first base portion is inserted into a first opening of the plurality of openings of the second base support, at least another base support of the second plurality of base supports of the first base portion is inserted into a second opening of the plurality of openings of the second base support, at least one base support of the second plurality of base supports of the third base portion is inserted into a third opening of the plurality of openings of the second base support, at least another base support of the second plurality of base supports of the third base portion is inserted into a fourth opening of the plurality of openings of the third base support to form a flat surface configured to receive a box spring or mattress.

18. The bed frame of claim 16, wherein the first base portion and the third base portion are identical.

19. The bed frame of claim 16, wherein the first base portion and the second base portion are dissimilar.

20. The bed frame of claim 16, wherein the second base portion and the third base portion are dissimilar.

* * * * *